US008207716B2

(12) United States Patent
Raedy et al.

(10) Patent No.: US 8,207,716 B2
(45) Date of Patent: Jun. 26, 2012

(54) USEFUL IMPROVEMENTS IN THE ART OF 3-PHASE ELECTRONIC TAP CHANGER COMMUTATION DEVICE

(75) Inventors: Steven M. Raedy, Clifton Park, NY (US); Doug Marble, Niskayuna, NY (US); Erick Singleman, Rensselaer, NY (US)

(73) Assignee: Utility Systems Technologies, Inc., Latham, NY (US)

( * ) Notice: Subject to any disclaimer, the term of this patent is extended or adjusted under 35 U.S.C. 154(b) by 868 days.

(21) Appl. No.: 12/257,874

(22) Filed: Oct. 24, 2008

(65) Prior Publication Data

US 2009/0102438 A1 Apr. 23, 2009

Related U.S. Application Data

(63) Continuation-in-part of application No. 11/249,831, filed on Oct. 13, 2005, now Pat. No. 7,737,667.

(60) Provisional application No. 60/618,829, filed on Oct. 14, 2004.

(51) Int. Cl.
*G05F 1/20* (2006.01)

(52) U.S. Cl. ..... 323/258; 323/343; 323/353

(58) Field of Classification Search ..... 323/258, 323/343, 256, 255, 257, 247, 259, 260, 261, 323/262–263, 353, 341–342, 340, 344; 363/64, 363/138, 160–162
See application file for complete search history.

(56) References Cited

U.S. PATENT DOCUMENTS

| | | | | |
|---|---|---|---|---|
| 3,555,403 | A | | 1/1971 | Matzl et al. |
| 3,621,374 | A | * | 11/1971 | Kettler ..... 323/343 |
| 3,662,253 | A | | 5/1972 | Yamamoto |
| 3,728,611 | A | * | 4/1973 | Elvin ..... 323/343 |
| 3,944,913 | A | | 3/1976 | Kugler |
| 4,622,513 | A | | 11/1986 | Stich |
| 5,006,784 | A | | 4/1991 | Sonntagbauer |
| 5,604,423 | A | | 2/1997 | Degeneff et al. |
| 5,604,424 | A | | 2/1997 | Shuttleworth |
| 5,694,034 | A | | 12/1997 | Dohnal et al. |
| 5,969,511 | A | | 10/1999 | Asselman et al. |
| 5,990,667 | A | | 11/1999 | Degeneff et al. |
| 6,087,738 | A | * | 7/2000 | Hammond ..... 307/17 |
| 6,137,277 | A | | 10/2000 | Rajda et al. |
| 6,384,581 | B1 | | 5/2002 | Sen et al. |

* cited by examiner

*Primary Examiner* — Harry Behm
(74) *Attorney, Agent, or Firm* — Baker & Hostetler LLP

(57) ABSTRACT

The invention is for a 3-phase electronic tap changer commutation device to be utilized in electronic regulators, and more particularly to 3-phase alternating current (AC) electronic tap-changing voltage, current or phase correcting regulators. The present invention provides a specific transformer winding topology and commutation technique that improves performance and reduces cost compared to conventional methods.

28 Claims, 3 Drawing Sheets

USEFUL IMPROVEMENTS IN THE ART OF 3-PHASE ELECTRONIC TAP CHANGER COMMUTATION DEVICE

CROSS REFERENCE TO RELATED APPLICATIONS

This application is a continuation-in-part of U.S. patent application Ser. No. 11/249,831, filed Oct. 13, 2005, now abandoned, but currently under petition for revival, which claims the benefit of U.S. Provisional Patent Application No. 60/618,829, filed 14 Oct. 2004, which is hereby incorporated herein by reference.

FIELD OF THE INVENTION

This invention applies to voltage regulators, and more particularly to 3-phase alternating current (AC) electronic tap-changing voltage, current and phase correcting regulators. The present invention provides a specific transformer winding topology and commutation technique that improves performance and reduces cost compared to conventional methods.

BACKGROUND OF THE INVENTION

Tap changing transformers are commonly used to regulate AC voltage in both low power, low voltage applications, and high power applications at distribution level voltages. Distribution level regulators typically consist of a multi-tapped transformer winding coupled to a mechanical tap changer so that regulation within +/−10% of nominal voltage is possible. These tap changer designs incorporate various mechanisms to ensure that, when transitioning from one tap to the next under load conditions, load current is not interrupted and arcing and inter-tap short circuit current are minimized.

In low voltage applications (less than 1000 Volts-rms) and low power applications (less than 1 Million Volt Amps) mechanical tap changers are often implemented using a simpler design incorporating a sliding commutation brush which can be positioned at arbitrary points along an exposed transformer winding in order to achieve the change in effective turns ratio. This technique has much lower cost than a discrete tap changer of the type used at higher power levels, but does not provide the same performance and also requires more maintenance.

Electronic tap changers are also commonly used in low voltage and low power (less than 1,000 VA) to moderate power (approximately 500 k Volt Amp) levels. Now, referring now to FIGS. 1-3, three known devices are shown. In FIG. 1 an electronic tap changer 10 comprises an electronic switch 20, 22, 24 connected to each tap 12, 14, 16 of a multi-tapped transformer 40 or auto transformer. Typically, each switch 20, 22, 24 includes anti-parallel (back-to-back) connected silicon controlled rectifiers (SCRs) 30, due to their low cost, simplicity, and ruggedness. By actively selecting which SCRs 30 are firing (e.g., by using appropriate sensing and gating controls, for example), the effective turns ratio of the transformer 40 can be controlled, so that the output voltage may be varied for a constant input voltage (when applied as an AC voltage source 50), or, when applied as a voltage regulator, the output voltage may be maintained within a certain tolerance under conditions of varying input voltage. Tap changer 10 may include other components, as would be recognized by one of ordinary skill in the art, including for example, ground connections 32, loads 34, etc.

An alternative implementation to the basic electronic tap changer 10 of FIG. 1 is shown in FIG. 2. Here, a series transformer secondary winding 60 reduces the current through the electronic switches 20, 22, 24, while increasing the voltage applied to each switch.

In any SCR-based 'on load tap changer', provisions must be made to avoid both load current discontinuity and high inter-tap circulating current when commutating the load current from a switch that is conducting to another switch (i.e., making a tap change). This is the same fundamental problem which must be addressed in the design of high power, 'discrete mechanical on-load' tap changers. The unique problem in the case of SCR based tap changers is a result of the conduction characteristics of SCRs; an SCR may be turned on at any arbitrary time by applying a signal to its gate, but the SCR will cease to conduct only when the load current naturally falls to zero or reverses (normally once each electrical half cycle).

When commutating from the 'present tap' to a 'new tap', if the new tap SCR is fired before the present tap SCR has ceased conducting, the two SCRs will form a short circuit current path across the two transformer taps until the 'present tap' SCR current reverses. This short circuit current is potentially damaging to the SCRs and transformer windings, and, as the short circuit current flows through the source impedance and the transformer impedance, may cause a decrease in the regulator's output voltage. Conversely, if a delay is used such that the 'present tap' SCR is allowed sufficient time to turn off and regain its voltage blocking ability before the 'new tap' SCR is activated, inductive loads may cause damaging or unacceptable voltage transients in response to the current discontinuity which exists during the delay period.

Previous tap changers, as shown in FIG. 3, solved the problems identified above by adding a commutating current path 70 through an impedance element, for example, a commutation resistor 80, an inductor (not shown), or other current limiting device. This is a basic representation of one of many methods commonly utilized in high power, mechanical tap changers. In the device shown as FIG. 3, when commutating from tap 12 to tap 14, the anti-parallel SCR pair 26 connected to the commutation impedance 80 is first gated, resulting in current flow between the two taps, taps 12 and taps 14, which is limited by the impedance 80 to an acceptable level. After the tap 12 conducting SCR 20 has naturally ceased to conduct and following a delay sufficient to ensure that the SCR 20 has regained its voltage blocking capacity, the tap 14 SCR pair, SCR 22 may be fired with no concern for a current discontinuity as the load current will flow through the impedance 80 of tap 14 until the SCR 22 is fired, at which time the gate signals of the anti-parallel SCR pair 26 are removed.

The wiring scheme of FIG. 3, or one of its known derivatives, could be implemented on each tap in a 3-phase regulator in order to implement an acceptable commutation scheme for all possible tap changes. The additional complexity of this scheme, however, results in substantial additional cost which may render the entire device impractical, and the additional control complexity and parts count reduces the reliability of the device.

SUMMARY OF THE INVENTION

The invention provides a novel 3-phase electronic tap changer commutation and related device. In one embodiment, the invention includes firing a 'commutation' silicon controlled rectifier (SCR), removing a gating signal from the presently conducting SCR connected to the first of a plurality of taps, firing a non-conducting SCR connected to a second of the plurality of taps, and removing a gating signal from the 'commutation' SCR.

The first aspect of the invention provides a method of commutating between a plurality of taps in a voltage regulating device, the method comprising: firing a 'commutation' circuit consisting of an anti-parallel connected pair of silicon controlled rectifiers (anti-parallel SCR pair) connected to a current limiting impedance; removing the gating signal from a conducting anti-parallel SCR pair connected to the first of the plurality of taps; firing a non-conducting SCR connected to the second of the plurality of taps; and removing the gating signal from the 'commutation' SCR.

The second aspect of the invention provides a method for substantially maintaining a voltage in a voltage regulating device. The method comprises: firing an SCR connected in series with a commutation impedance; removing the gating signal from the presently conducting SCR, whereby the load current of the presently conducting SCR is allowed to fall to zero as the voltage polarity applied by the source reverses; firing a presently non-conducting SCR connected to the desired tap; and removing the gating signal from the commutating SCR, whereby the commutation impedance and commutating SCR cease to conduct current.

The third aspect of the invention provides an alternating current voltage regulating device comprising: a commutation impedance; a commutation anti-parallel pair of SCRs; and at least one phase transformer including a plurality of taps, wherein the commutation impedance and the commutation anti-parallel pair of SCRs substantially maintain the load voltage for a period when none of the normally conducting SCRs, connected to any of the plurality of taps, is conducting.

The illustrative aspects of the present invention are designed to solve the problems herein described and other problems not discussed, which are discoverable by a skilled artisan.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

DETAILED DESCRIPTION

Figure 1:
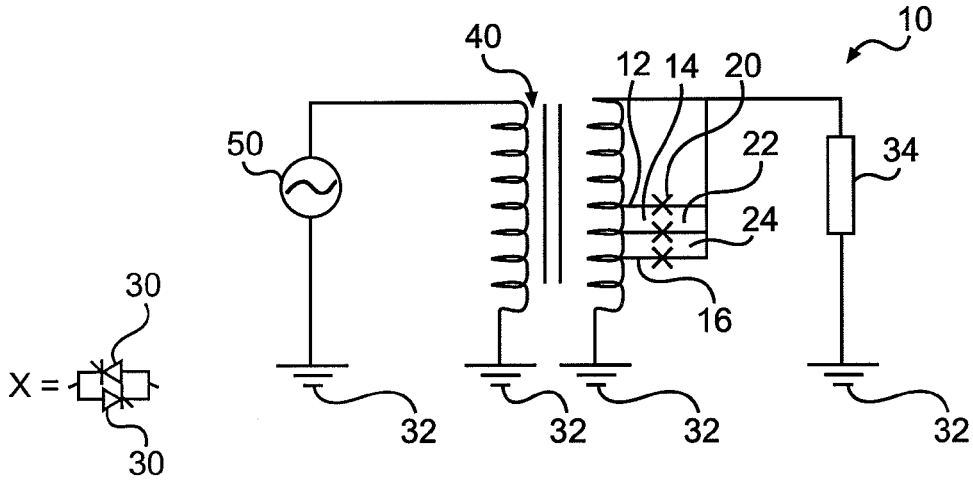
FIG. 1 PRIOR ART
FIGS. 1-3 show schematic diagrams of illustrative known devices.
Figure 2:
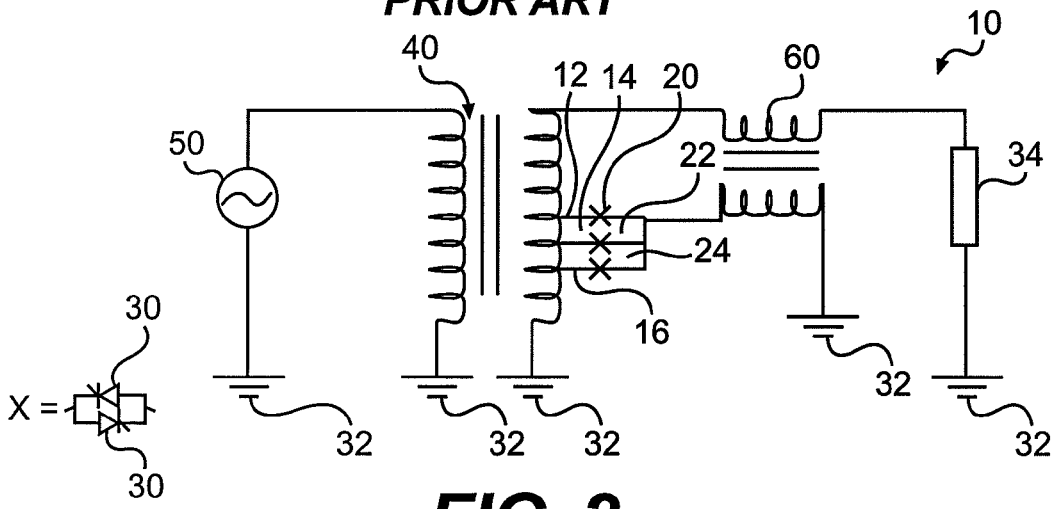
FIG. 2 PRIOR ART
Figure 3:
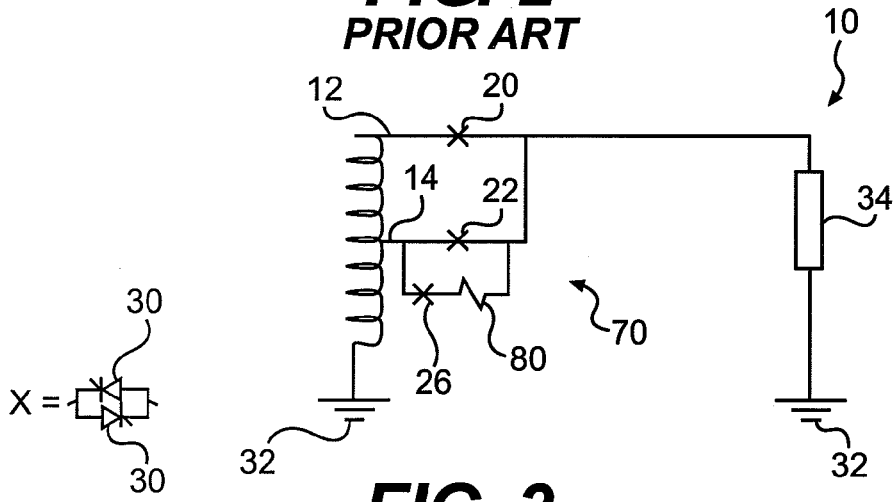
FIG. 3 PRIOR ART
Figure 4:
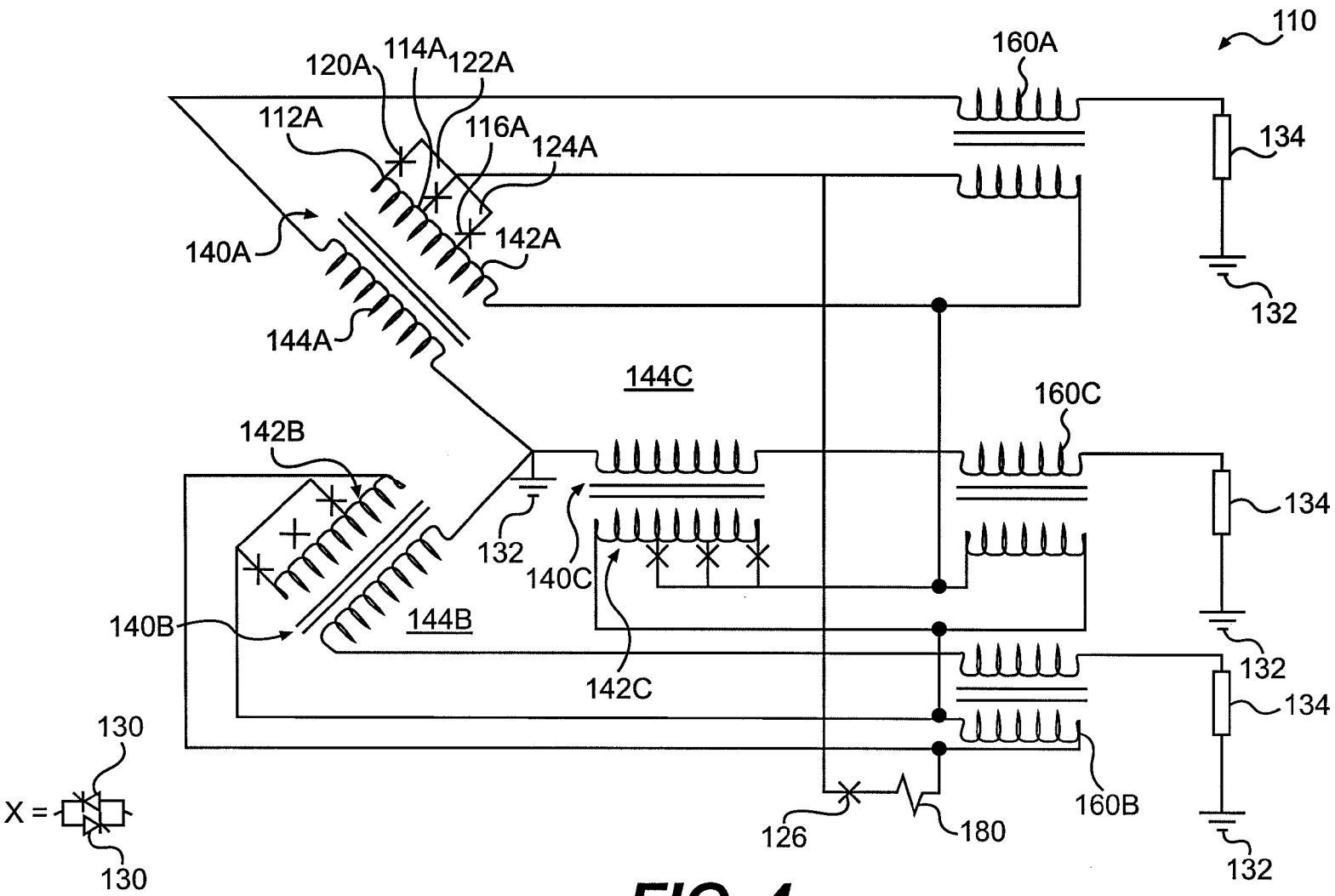
FIG. 4 shows a schematic diagram of an illustrative embodiment of the invention.

The embodiments of the 3-phase electronic tap changer will be described with reference to the drawing figures. A first embodiment is shown in FIG. 4 providing a topology and control method for implementing an acceptable commutation method for a poly-phase AC electronic voltage regulator using only a single commutation impedance component and its associated anti-parallel SCR pair. The topology of the invention is shown in FIG. 4. For the sake of brevity, FIG. 4 shows only three tap selections 120A, 122A, 124A for one (i.e., 140A) of the three phases 140A-C. However, an actual implementation of the invention would typically contain additional taps. This basic topology utilizes series connected transformers 160A-C and also makes an additional modification to the basic topology by utilizing a tapped winding 142A-C that is separate from the main secondary winding 144A-C.

An analysis of this topology 110 reveals that the anti-parallel SCR pairs associated with any of the three phases 140A-C may be allowed to cease conducting as long as the commutation anti-parallel SCR pair 126 is conducting. As such, a boost or buck voltage applied to the phase undergoing the commutation will equal the vectorial sum of the voltage being added to the other two phases, i.e., the sum of the voltage vectors across the other two buck/boost transformers. In a three-phase system, the boost or buck voltage required by all three phases is generally equal. Accordingly, the voltage buck or boost under this condition will generally be similar to the desired buck or boost under the normal condition in which the tap winding anti-parallel SCR pairs are conducting.

A control scheme can be implemented using the topology 110 of FIG. 4. Under normal conditions, the commutation anti-parallel SCR pair 126 is not conducting, so that each tap winding (e.g., 142A, 142B, 142C) is connected to its corresponding series transformer (e.g., 160A-C), and all of the current flowing through the primary windings of the series transformer (e.g., 160A-C) is carried by the tap windings of the corresponding transformer phase (e.g., 142A-C).

Figure 5:
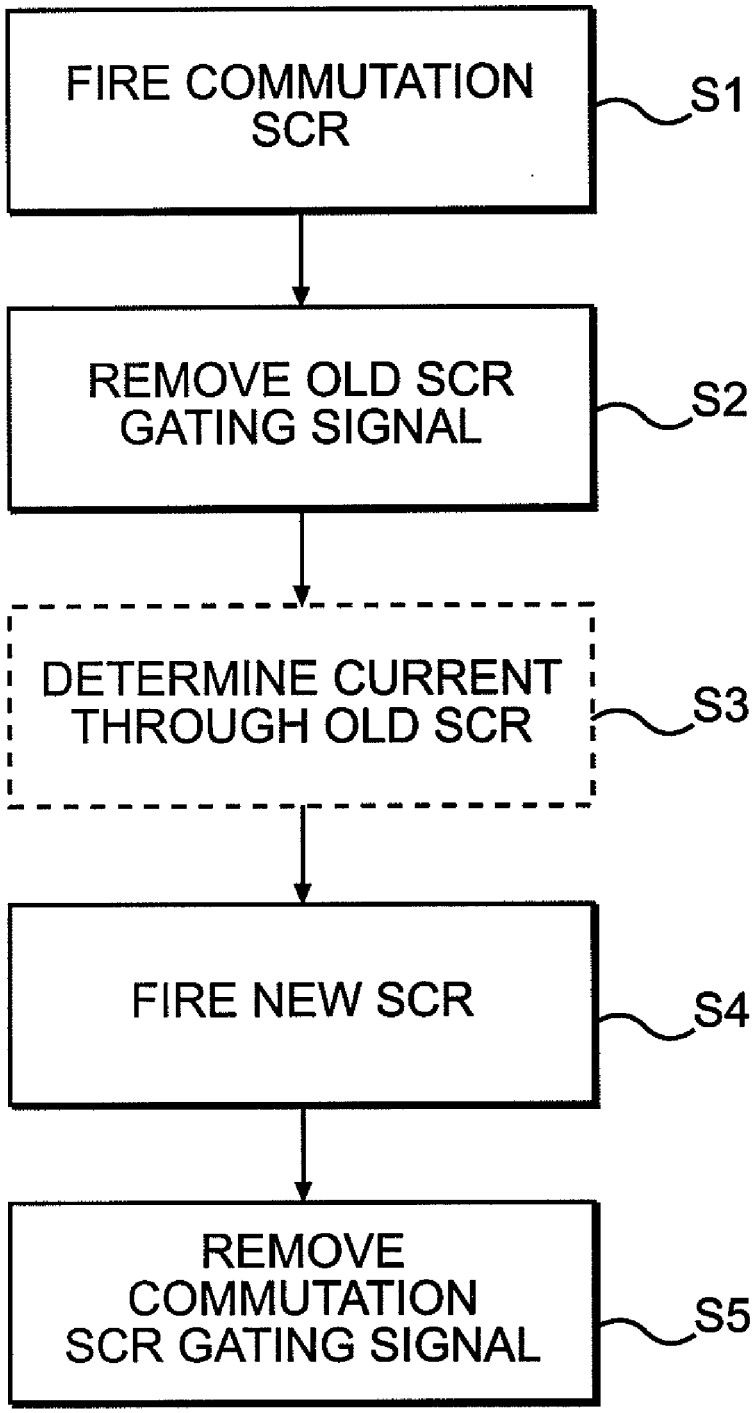
FIG. 5 shows a block diagram of an illustrative method according to the invention.

Referring now to FIG. 5, a block diagram of an illustrative method of commutating from a presently conducting anti-parallel SCR pair (e.g., 120A in FIG. 4) to a presently non-conducting anti-parallel SCR pair (e.g., 122A in FIG. 4) is shown. First, at step S1 (FIG. 5, the top block in the block diagram), the commutation anti-parallel SCR pair 126 (FIG. 4) is fired such that it remains in an AC conductive state. At this point, if the vectorial sum of the three individual phase voltages being applied to the three buck/boost transformers is non zero, a current will flow through the commutating impedance 180 (FIG. 4) equal to the vectorial sum of the three buck/boost voltages divided by the commutating impedance value in Ohms.

Next, at step S2 (FIG. 5, the second block of the block diagram), the gating signals to the presently conducting anti-parallel SCR pair 120A are removed, so that its load current may be allowed to naturally fall to zero and the presently conducting anti-parallel SCR pair 120A ceases conducting current shortly after the polarity of the AC voltage source reverses. At this point, the primary current of the series transformer 160A (FIG. 4) is supplied via the path which includes the commutating impedance 180 (FIG. 4), the commutating anti-parallel SCR pair SCR 126 (FIG. 4) and the tap windings of the other two phases 142B, 142C (FIG. 4).

At optional step S3 (FIG. 5, the third block in the block diagram), the current flowing through the presently conducting anti-parallel SCR pair 120A is measured, e.g., through any known or later-developed measurement method, to ensure that the SCR current has reached zero and the SCR has regained its ability to block forward voltage. Alternatively, it may be assumed that the current through the anti-parallel SCR pair has reached zero after a fixed delay time (typically more than ½ of an electrical cycle).

Next, at step S4 (FIG. 5, the fourth block in the block diagram), the presently non-conducting anti-parallel SCR pair 122A is fired. Finally, at step S5 (FIG. 5, the bottom block in the block diagram), the gating signal to the commutation anti-parallel SCR pair 126 is removed, so that after a maximum of approximately ½ electrical cycle, the commutation SCR 126 and resistor 180 cease to conduct current.

The purpose of this scheme, as outlined in the single phase example above, is to provide a method for maintaining a continuous current through the series transformer associated with the phase undergoing a tap change and substantially maintaining the voltage across the series transformer primary winding during the commutation period, such that the output voltage of the voltage regulator does not differ appreciably from the desired voltage.

The topology and method described herein require far fewer components and control complexity than would otherwise be required. That is, the present invention provides equal or similar performance to a scheme that utilizes a commutation resistor and anti-parallel SCR pair in conjunction with each tap winding anti-parallel SCR pair, but at greatly reduced cost and complexity.

It should be understood that the present invention works with switching solid-state semiconductor devices. Theses devices are synonymously know as Silicon Controlled Rectifiers (SCRs), anti-parallel SCRs, back-to-back SCRs, triode AC switches (triacs), gate turn-off thyristors (GTOs), static induction transistor (SITs), static induction thyristor (SITHs) or MOS-controlled thyristors (MCTs) and the present invention should not limited to the above named electronic switching devices.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of changing an effective ratio of a transformer by commutating between a plurality of transformer taps in an electrical power conditioning device, the method comprising:

affixing a commutation gating signal to a commutation electronic switch, wherein the commutation electronic switch is coupled to an impedance device;

removing a first gating signal from a first electronic tap switch connected to a first transformer tap thereby causing first transformer's current to flow through the commutation electronic switch;

affixing a second gating signal to a second electronic tap switch associated with a second transformer tap;

removing the commutation gating signal from the commutation electronic switch; and, maintaining a constant voltage at a first transformer primary winding by applying a vectorial sum of voltages in a plurality of remaining transformer primary windings.

2. The method of claim 1, wherein the first electronic tap switch and the second electronic tap switch are circuits comprised of one or more Silicon Controlled Rectifiers (SCRs), anti-parallel SCRs, back-to-back SCRs, triode AC switches (triacs), gate turn-off thyristors (GTOs), static induction transistor (SITs), static induction thyristor (SITs), MOS-controlled thyristors (MCTs), Insulated Gate Bipolar Transistors (IGBTs), Darlington Transistors, and Metal Oxide Semiconductor Field Effect Transistors (MOSFETs).

3. The method of claim 1, wherein the commutation electronic switch is a circuit comprised of one or more Silicon Controlled Rectifiers (SCRs), anti-parallel SCRs, back-to-back SCRs, triode AC switches (triacs), gate turn-off thyristors (GTOs), static induction transistor (SITs), static induction thyristor (SITHs), MOS-controlled thyristors (MCTs), Insulated Gate Bipolar Transistors (IGBTs), Darlington Transistors, and Metal Oxide Semiconductor Field Effect Transistors (MOSFETs).

4. The method of claim 1, further comprising the step of determining a value of a current flowing through the commutation electronic switch.

5. The method of claim 1, wherein the impedance device is a resistor, an inductor or a combination of the resistor and the inductor.

6. The method of claim 1, wherein the impedance device maintains transformer currents and transformer voltages approximately constant during commutation process.

7. The method of claim 1, further comprises engaging at least another electronic tap switch when current in conducting transformer tap's electronic switch falls to zero due to a polarity reversal of a sinusoidal AC voltage applied by an AC power source, thus permitting a network of electronic switches to engage another tap.

8. The method of claim 1, wherein an output voltage of the electrical power conditioning device is substantially maintained and a load current of the electrical power conditioning device is continuously maintained during commutation from the conducting transformer winding tap to a non-conducting transformer winding tap.

9. An alternating voltage regulating device comprising an alternating voltage commutation circuit; said alternating voltage commutation circuit comprising:

a commutation electronic switch and an impedance device;

at least one shunt connected transformer with a plurality of transformer taps connected to at least one series connected transformer by one or by a plurality of electronic tap switches, wherein the commutation electronic circuit substantially maintains an output voltage and current of the alternating voltage regulating device and provides a continuous path for a load current for a period when none of the plurality of transformer taps in said at least one shunt connected transformer is conducting; and a control circuit that regulates the output voltage of the alternating voltage regulating device by changing the plurality of transformer taps without a current measurement circuit that would otherwise be necessary to determine when a current through the commutation electronic switch has decayed to zero and voltage blocking capability of the commutation electronic switch has been restored.

10. The device of claim 9, wherein each of the plurality of transformer taps is connected to a series connected transformer by an electronic tap switch.

11. The device of claim 9, further comprising three or more shunt connected single phase transformers connected in a polyphase configuration to an input terminal or an output terminal of the alternative voltage regulating device, or one or more shunt connected multi-phase transformers, with each of said shunt transformer including a plurality of taps.

12. The device of claim 9, wherein at least one series connected transformer is connected in series with a main current path between the input terminals and the output terminals of the voltage regulating device.

13. The device of claim 9, wherein a commutation circuit provides a continuous conduction path from an input terminal of the alternating voltage regulation device to an output terminal of the alternating voltage regulation device such that the load current is maintained uninterrupted.

14. An alternating current regulating device comprising an alternating current regulating commutation circuit, the alternating current regulating commutation circuit comprising:

an alternating current regulating commutation electronic switch and an impedance device;

at least one shunt connected transformer with a plurality of transformer taps connected to at least one series connected transformer by one or by a plurality of electronic tap switches, wherein the commutation electronic switch substantially maintains an output voltage and a current of the alternating current regulating device and provides a continuous path for a load current for a period when none of the plurality of transformer taps in said shunt connected transformer is conducting; and a control circuit that regulates an output current by changing the plurality of transformer taps without complexity and cost of a current measurement circuit that would otherwise be necessary to determine when a current through the commutation electronic switch has decayed to zero and a voltage blocking capability of the commutation electronic switch has been restored.

15. The device of claim 14, wherein each of the plurality of transformer taps is connected to a series connected transformer by an electronic switch.

16. The device of claim 14, further comprising three or more shunt connected single phase transformers connected in a polyphase configuration to an input terminal or an output terminal of the alternating current regulating device, or one or more shunt connected multi-phase transformers, with each of said at least one shunt connected transformer including a plurality of transformer taps.

17. The device of claim 14, wherein at least one series regulating transformer is connected in series with a main current path between an input terminal and an output terminal of the alternating regulating device.

18. The device of claim 14, wherein the alternating current regulating commutation circuit provides a continuous conduction path from an input terminal of the alternating current regulation device to an output terminal of the alternating current regulation device such that the load current is maintained uninterrupted.

19. An alternating current phase or power factor regulating device comprising:

a power factor commutation circuit;

said power factor commutation circuit comprising:

a commutation electronic switch and an impedance device;

at least one shunt connected transformer with a plurality of transformer taps connected to at least one series connected transformer by one or by a plurality of electronic tap switches, wherein the power factor commutation circuit substantially maintains an output voltage and current of the phase or power factor regulating device and provides a continuous path for a load current for a period when none of the plurality of transformer taps in said at least one shunt connected transformer is conducting; and a control circuit that regulates an output phase or power factor by changing the plurality of transformer taps without complexity and cost of a current measurement circuit that would otherwise be necessary to determine when a current through the commutation electronic switch has decayed to zero and a voltage blocking capability of the commutation electronic switch has been restored.

20. The device of claim 19, wherein each of the plurality of transformer taps is connected to a series connected transformer by an electronic switch.

21. The device of claim 19, further comprising three or more shunt connected single phase transformers connected in a polyphase configuration to an input terminal or an output terminal of the phase or power factor regulating device, or one or more shunt connected multi-phase transformers, with each of said at least one shunt connected transformer including a plurality of transformer taps.

22. The device of claim 19, wherein at least one series regulating transformer is connected in series with a main current path between an input terminal and an output terminal of the phase or power factor regulating device.

23. The device of claim 19 wherein the power factor commutation circuit provides a continuous conduction path from an input terminal of the phase or power factor regulation device to an output terminal of the phase or power factor regulation device such that the load current is maintained uninterrupted.

24. An alternating current regulating device for changing an effective ratio of a transformer by commutating between a plurality of transformer taps in an electrical power conditioning device;

means for activating configured to activate a commutation electronic switch;

means for removing configured to remove a first gating signal from a first electronic tap switch connected to a first transformer tap thereby causing the first transformer's current to flow through the commutation electronic switch;

means for affixing configured to affix a second gating signal to a second electronic tap switch associated with a second transformer tap;

means for removing configured to remove the commutation gating signal from the commutation electronic switch; and means for maintaining configured to maintain a constant voltage at a first transformer primary winding by applying a vectorial sum of voltages in a plurality of remaining transformer primary windings.

25. A method of changing an effective ratio of a transformer by commutating between a plurality of transformer taps in an electrical power conditioning device, the method comprising:

affixing a commutation gating signal to a commutation electronic switch, wherein the commutation electronic switch is coupled to an impedance device;

removing a first gating signal from a first electronic tap switch connected to a first transformer tap thereby causing first transformer's current to flow through the commutation electronic switch;

affixing a second gating signal to a second electronic tap switch associated with a second transformer tap;

removing the commutation gating signal from the commutation electronic switch; and further utilized in a 3 phase power application where the commutation process changes one phase at a time and during time when one phase is connected through the commutation electronic switch, a second transformer's primary windings and a third transformer's primary windings are interconnected such that vectorial sum of voltages of the second transformer's primary windings and the third transformer's primary windings primary maintains the vectorial sum voltage applied to the first transformer primary.

26. An alternating voltage regulating device comprising an alternating voltage commutation circuit; said alternating voltage commutation circuit comprising:

a commutation electronic switch and an impedance device;

at least one shunt connected transformer with a plurality of transformer taps connected to at least one series connected transformer by one or by a plurality of electronic tap switches, wherein the commutation electronic circuit substantially maintains an output voltage and current of the alternating voltage regulating device and provides a continuous path for a load current for a period when none of the plurality of transformer taps in said at least one shunt connected transformer is conducting; and wherein the alternating voltage commutation circuit substantially maintains the alternating voltage regulating device output voltage and provides a continuous conduction path from an input terminal of the alternating voltage regulation device to an output terminal of the alternating voltage regulation device for all three or more electrical phase outputs of the alternating voltage regulating device.

27. An alternating current regulating device comprising an alternating current regulating commutation circuit, the alternating current regulating commutation circuit comprising:

an alternating current regulating commutation electronic switch and an impedance device;

at least one shunt connected transformer with a plurality of transformer taps connected to at least one series connected transformer by one or by a plurality of electronic tap switches, wherein the commutation electronic switch substantially maintains an output voltage and a current of the alternating current regulating device and provides a continuous path for a load current for a period when none of the plurality of transformer taps in said shunt connected transformer is conducting; and wherein the alternating current regulating commutation circuit substantially maintains the alternating current regulating device's output current and provides a continuous conduction path from an input terminal of the alternating current regulation device to an output terminal of the alternating current regulation device for all three or more electrical phase outputs of the alternating current regulating device.

28. An alternating current phase or power factor regulating device comprising:

a power factor commutation circuit; the power factor commutation circuit comprising:

a commutation electronic switch and an impedance device;

at least one shunt connected transformer with a plurality of transformer taps connected to at least one series connected transformer by one or by a plurality of electronic tap switches, wherein the power factor commutation circuit substantially maintains an output voltage and current of the phase or power factor regulating device and provides a continuous path for a load current for a period when none of the plurality of transformer taps in said at least one shunt connected transformer is conducting; and wherein the power factor commutation circuit substantially maintains the phase or power factor regulating devices output voltage and current and provides a continuous conduction path from an input terminal of the phase or power factor regulation device to an output terminal of the phase or power factor regulation device for all three or more electrical phase outputs of the phase or power factor regulating device.

* * * * *